US007155853B2

(12) United States Patent
Valiulis

(10) Patent No.: US 7,155,853 B2
(45) Date of Patent: Jan. 2, 2007

(54) MERCHANDISE LABELS FOR MERCHANDISER UNITS AND METHOD AND LABELING SYSTEM USING SAME

(75) Inventor: Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 24 days.

(21) Appl. No.: 10/689,283

(22) Filed: Oct. 20, 2003

(65) Prior Publication Data

US 2005/0081417 A1 Apr. 21, 2005

(51) Int. Cl.
*G09F 3/18* (2006.01)

(52) U.S. Cl. ..... 40/661; 40/649; 40/651; 40/638; 40/661.03; 40/642.01

(58) Field of Classification Search ..... 40/650, 40/651, 649, 661, 642.01, 661.03, 638; 283/81; 428/40.1, 343

See application file for complete search history.

(56) References Cited

U.S. PATENT DOCUMENTS

| | | | | |
|---|---|---|---|---|
| 2,990,196 | A * | 6/1961 | Slavsky | 40/661.03 |
| 4,351,440 | A * | 9/1982 | Thalenfeld | 40/642.01 |
| 5,070,966 | A * | 12/1991 | Brennan | 186/61 |
| 5,458,307 | A * | 10/1995 | Gebka | 40/661.03 |
| 5,464,681 | A * | 11/1995 | Luce | 428/195.1 |
| 6,145,231 | A * | 11/2000 | Valiulis | 40/661.03 |
| 6,263,603 | B1 * | 7/2001 | Wildrick | 40/661 |
| 6,385,884 | B1 | 5/2002 | Valiulis | |
| 6,385,885 | B1 | 5/2002 | Valiulis | |
| 6,408,553 | B1 * | 6/2002 | Brown et al. | 40/661.03 |
| 6,470,613 | B1 | 10/2002 | Wildrick | |
| D470,535 | S | 2/2003 | Valiulis | |
| D470,893 | S | 2/2003 | Valiulis et al. | |
| 6,519,885 | B1 | 2/2003 | Valiulis | |
| D472,278 | S | 3/2003 | Valiulis | |
| D475,753 | S | 6/2003 | Valiulis | |
| 6,581,314 | B1 | 6/2003 | Valiulis | |
| 6,632,316 | B1 * | 10/2003 | Garvic | 156/247 |
| 2001/0047604 | A1 * | 12/2001 | Valiulis | 40/661.03 |

OTHER PUBLICATIONS

American Coated Products, *High Quality Coating and Laminating*, Oct. 9, 2003, 2 website pages.
Flexographic Technical Association, *Water-Based Adhesives*, Oct. 9, 2003, 4 website pages.
American Coated Products, *Roll Label & Specialty Laminates* , Oct. 9, 2003, 2 website pages.

* cited by examiner

*Primary Examiner*—Gary C. Hoge
(74) *Attorney, Agent, or Firm*—Reinhart Boerner Van Deuren P.C.

(57) ABSTRACT

The application discloses a friction coated label and labeling sheet for use in labeling a label holder of a merchandiser unit that supports merchandise in which the label holder has means for supporting one or more labels without an adhesive bond. The labeling sheet comprises a plurality of friction coated labels removably secured to the release liner. The friction-coated labels include a face stock and a friction coating integrally connected to the face stock. The face stock has printed indicia thereon relating to the merchandise. The friction coating may comprise a weak adhesive that is adapted to inhibit migration of the friction coated labels but is not strong enough to provide a self supporting reliable adhesive bond for retail applications.

12 Claims, 7 Drawing Sheets

MERCHANDISE LABELS FOR MERCHANDISER UNITS AND METHOD AND LABELING SYSTEM USING SAME

FIELD OF THE INVENTION

This invention relates generally to labels and labeling systems and more particularly to such labels and labeling systems for merchandiser units such as merchandise hangers, shelving, and racks, and other such marketing displays.

BACKGROUND OF THE INVENTION

As is well known, a variety of hangers, shelves, shelving, racks and other such merchandise supports, herein referred to as merchandisers or merchandiser units, are used to support and usually display merchandise for convenient viewing and access by customers. Retailers are one type of entity that typically use such merchandiser units. A label support is often provided on each merchandiser unit for supporting and prominently exhibiting a label that may contain pricing, bar codes, stock keeping units and other information and indicia pertaining to the merchandise on the merchandiser unit.

In such merchandiser units, it is desirable to permit the ready application, removal and exchange of information labels, e.g. such as in instances of changing of the products, prices, sales announcements, images which facilitate inventorying, and other pertinent information.

In this regard, Southern Imperial, Inc., the present assignee to this patent application, has obtained several patents including U.S. Pat. Nos. 6,385,884, 6,385,885, and 6,519,885 directed toward display panels that have a release coating such as silicone for ready attachment, removal and replacement of adhesive labels. Such adhesive labels typically have a permanent type adhesive which when applied to typical metal or plastic surfaces causes excessive residue (e.g. sticky adhesive and/or face stock material) to be left behind. This requires an intense cleaning effort in order to fully remove the labels and/or residue left behind. This foregoing invention which has been commercially employed under the trademark LABEL RELEASE® has proved to be beneficial in many applications and has enjoyed commercial success.

Although this technology has been significant innovation in the art, there are applications where non-adhesive labels are used. For example, there are extruded plastic label holders for peg hooks and/or shelf channels which generally include two planar transparent plastic panels connected at the bottom and which define a generally planar pocket therebetween. These label holders receive a non-adhesive label such as a paper tag or paper card, in which the bottom of the label holder typically supports the gravitational weight of the label (sometimes a clamping action facilitated by an integral hinge in the plastic label holder may also provide for retention). Examples of such label holders, commonly referred to as extruded plastic label holders are disclosed in U.S. Pat. Nos. 6,581,314, 6,470,613, D470,535, D472,278, D475,753, and D470,893, all assigned to Southern Imperial, Inc., and all of which are hereby incorporated by reference in their entireties.

One problem as it generally relates to extruded plastic label holders is that non-adhesive labels sometimes tend to migrate or wander out of position once installed into the intended pocket. This can occur due to customers pulling merchandise off the merchandiser units, which generates vibrations and the like, which in turn can cause a non-adhesive label to migrate out of position over time. This can be particularly problematic when the merchandiser unit is not perfectly level in the horizontal plane, which allows vibrations and the like to cause the labels to migrate out of position and downhill over time. In terms of retail stores, this can be significant problem in that customers may not be properly informed of pricing information and may not purchase an item based on the lack of information or due to the frustration in locating information. Further if excessive label migration occurs, the wrong product could end up being labeled with the wrong price information. In some states, there are laws that require retailers to sell at the listed price. Therefore, if the listed price is wrong due to label migration, this can be an added cost to a retailer.

The label migration problem is also applicable to C-channel shelving units in which non-adhesive labels are snapped in to the C-channel at the front end of a shelving unit.

Accordingly, there has existed a problem which is in need of a suitable solution.

BRIEF SUMMARY OF THE INVENTION

The present invention is directed in part toward a labeling sheet for use in a merchandiser unit that supports merchandise, in which the merchandiser unit includes a label holder with means for supporting one or more labels without an adhesive bond. The labeling sheet comprises a plurality of friction coated labels removably secured to a release liner. The friction coated labels including a face stock and a friction coating integrally connected to the face stock. The face stock has printed indicia thereon that relates to the intended merchandise. The friction coating comprises a weak adhesive that is adapted to inhibit migration of the label relative to the label holder when held thereby but is not strong enough to adhesively secure the labels to the label holder without the support means for retail use. The advantage of a weak adhesive is that it does not inhibit manual installation or removal.

The present invention is also directed in part toward a labeling system for using labels to provide information pertaining to merchandise. The labeling system comprises a merchandiser adapted to support merchandise and a label holder mounted to the merchandiser. The label holder includes means such as a clamping mechanism and/or a bottom support for supporting one or more labels without an adhesive bond. A friction coated label is removably secured to the label holder by the support means, the label including a face stock and a friction coating. The face stock has printed indicia thereon relating to the merchandise. The friction coating is disposed between the face stock and the label holder to inhibit migration of the label relative to the label holder.

The present invention is also directed in part toward a method of labeling merchandise using a label comprising multiple layers including a release liner, a face stock, and a friction coating in which the friction coating is integrally connected to the face stock. The method comprises:

- cutting the label stock material into a plurality of labels;
- printing indicia on the face stock related to the merchandise;
- removing the labels from the liner;
- releasably securing at least one of the labels to a label holder of a merchandiser; and
- supporting the labels with the label holder regardless of whether an adhesive bond exists between the label and the label holder, the friction coating engaging label holder to inhibit migration of the label relative to the label holder.

Other aspects, objectives and advantages of the invention will become more apparent from the following detailed description when taken in conjunction with the accompanying drawings.

DETAILED DESCRIPTION OF THE INVENTION

The following embodiments or examples further illustrate the invention but, of course, should not be construed as in any way limiting its scope.

Figure 2:
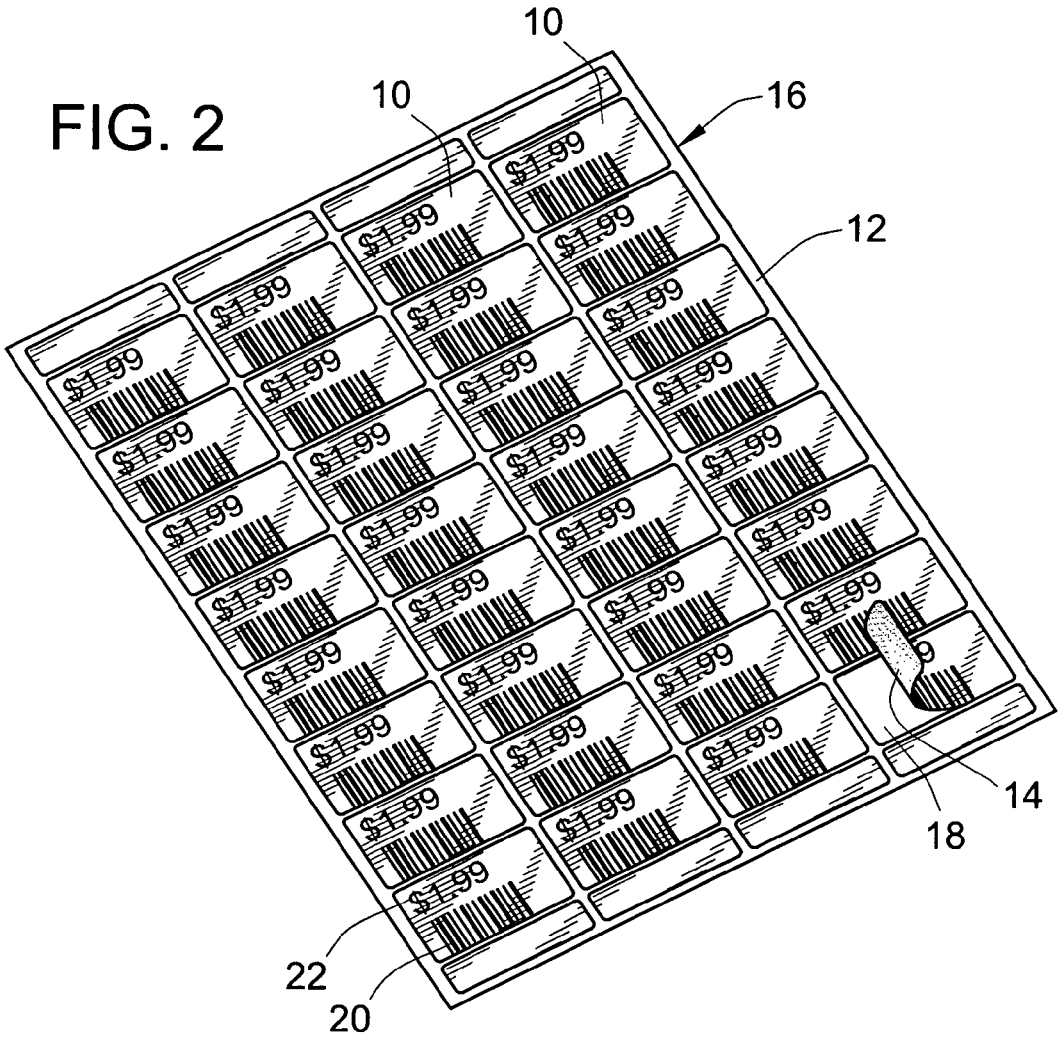
FIG. 2 is a perspective illustration of a sheet of friction coated labels on a release liner in accordance with an embodiment of the present invention.
Figure 3:
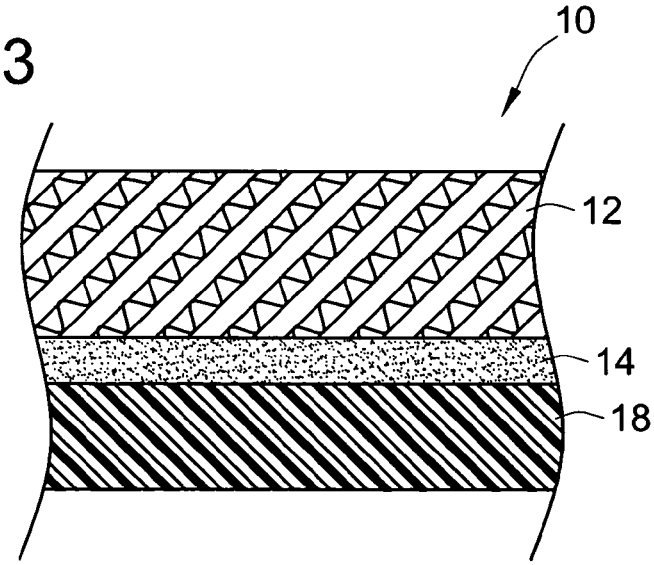
FIG. 3 is a cross section of a portion of the sheet shown in FIG. 2.

Referring to FIGS. 2 and 3, an embodiment of the present invention comprises a friction coated label 10 comprising a planar layer of face stock 12 and a planar layer of friction coating 14 on at least one side of the face stock 12. The face stock 12 typically comprises paper material, but may include one or more of the following types of materials: polypropylene, polyethylene, polyester, polyolefin, polystyrene, other polymeric materials, vinyl, paper, or other suitable merchandise labeling material. The friction coating 14 may be an adhesive and is preferably a weak adhesive that may be any suitable type of adhesive including rubber based adhesive, acrylic emulsion adhesive, dry bond, holt-melt adhesive, solvent based adhesive, water based adhesive, or any other suitable adhesive for merchandise labels.

Also to facilitate easier handling, die cutting and printing operations, friction coated labels 10 preferably typically organized in a sheet 16 (which may be a planar cut sheet or which may be rolled up in a continuous roll) and removably bonded to a release liner 18. The release liner 18 may comprise any of the materials described for the face stock material above, and typically includes an integral release coating such as silicone to which adhesive will stick but allows for easy manual release.

Figure 7:
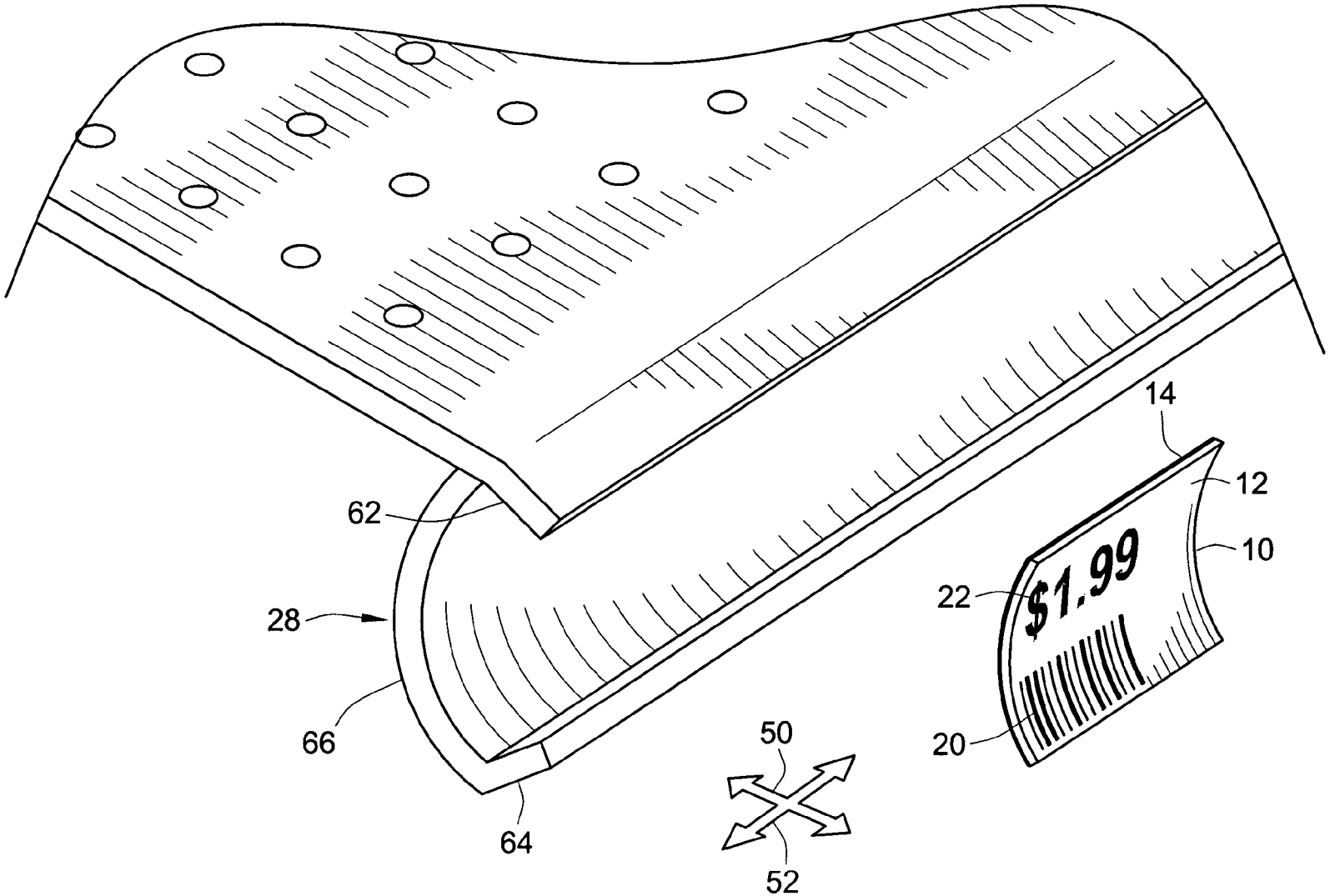
FIG. 7 is a perspective illustration of a friction coated label being installed on a C-Channel shelf.

The label 10 typically has printed indicia such as a bar code 20 and price information 22 that relate to merchandise. As illustrated in the FIGS. 4, 5 and 7, the labels 10 can be installed on various types of label holders including extruded plastic label holders 24, 26 shown in FIGS. 4 and 5, metal or plastic C-Channel shelves 28 as shown in FIG. 7, or any other suitable merchandiser unit.

Figure 4:
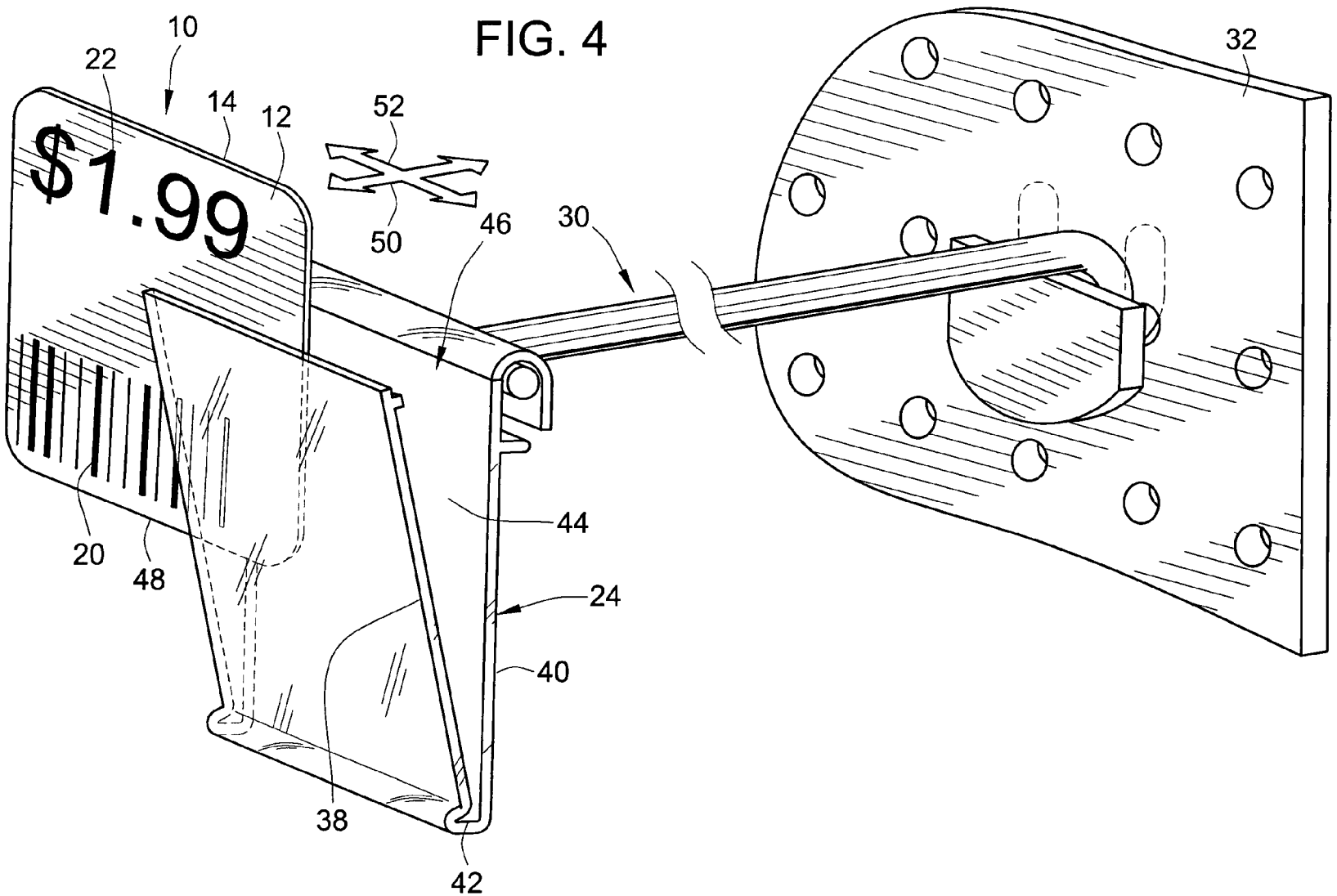
FIG. 4 is a perspective illustration of a friction coated label being installed on an extruded plastic label holder of the peg-hook type.
Figure 5:
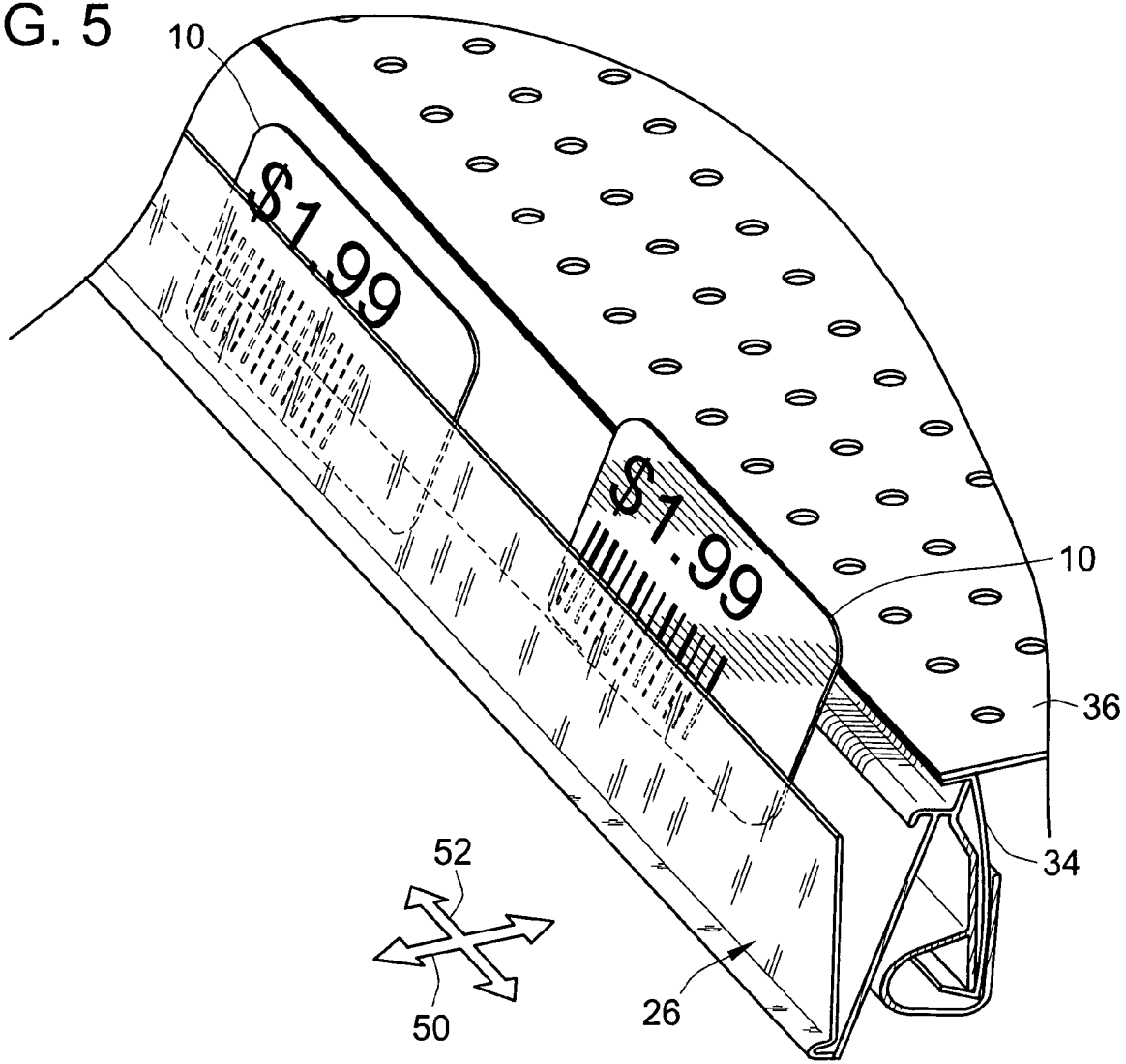
FIG. 5 is a perspective illustration of a friction coated label being installed on an extruded plastic label holder that has been mounted into a C-Channel shelf.

The extruded plastic label holders 24, 26 shown in FIGS. 4 and 5 are similar in many respects as in relates to the present invention. The label holder 24 shown in FIG. 4 is for a peg hook application in which the label holder 24 is mounted to the front end of a wire peg hook 30 that is secured to a peg board 32. Such peg hooks 30 typically will support and hold merchandise between the label holder 24 and the peg board 32. The label holder 26 shown in FIG. 5 is for a shelf application and is mounted to the front end of a horizontal shelf 34, which has a top surface 36 that supports merchandise.

Referring to FIG. 4, the plastic label holder 24 typically includes a front plastic panel 38 (which is typically transparent or includes an opening), a back panel 40 (which may or may not be transparent), and a support base 42 at the bottom of the panels 38, 40 extending laterally therebetween. The support base 42 also serves as an integral hinge to allow for relative pivoting movement of the panels 38, 40 to allow for easier installation and removal of labels 10. Between the front and back panels 38, 40 is a space or pocket 44 which is adapted to receive and hold labels 10. The label holder 24 also includes a label entrance 46 above the support base 42 that facilitates vertical and/or horizontal installation and removal of labels 10 into the label pocket 44.

Figure 6:
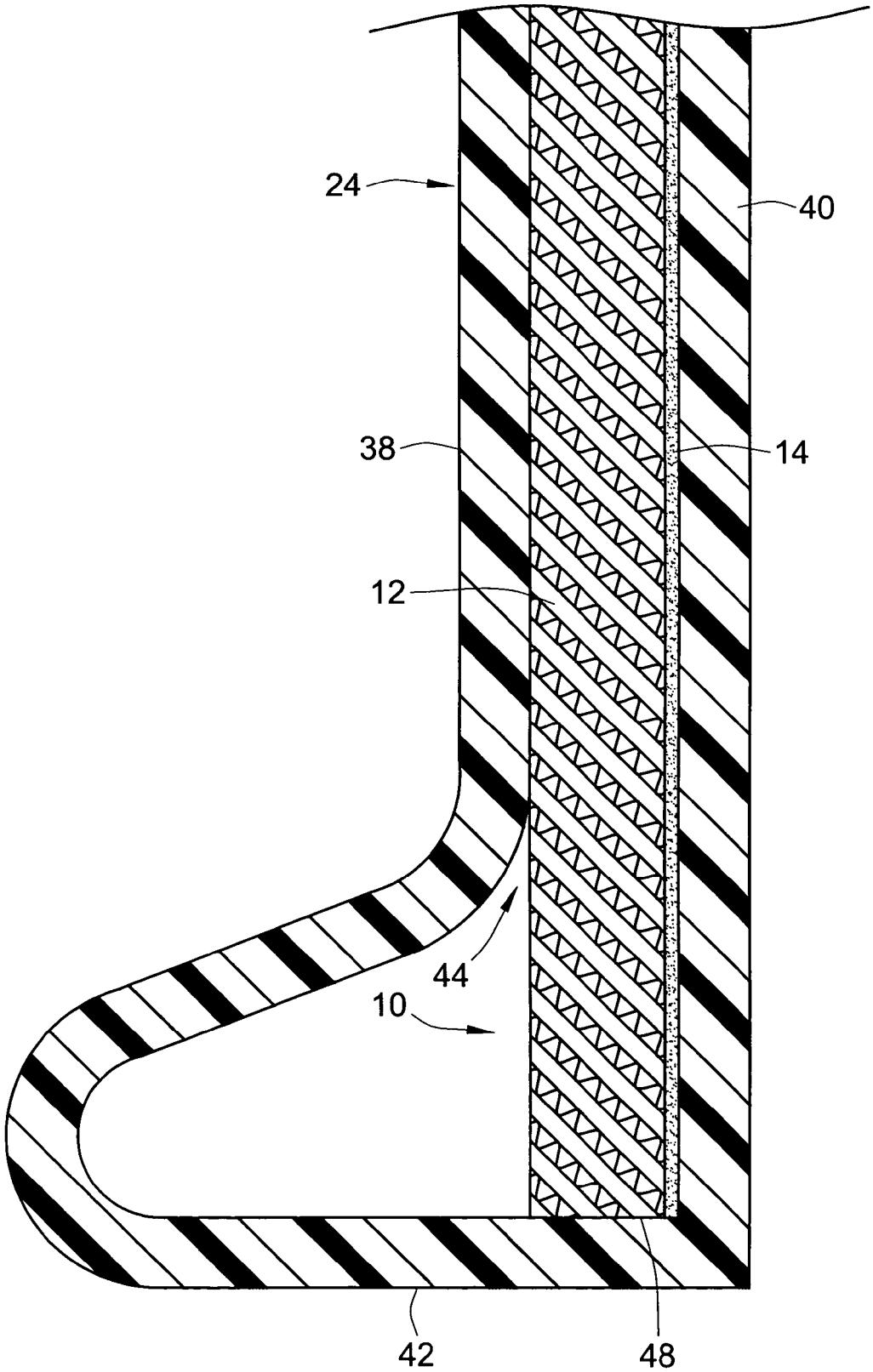
FIG. 6 is a cross sectional illustration of a friction coated label as installed in the pocket of an extruded plastic label holder such as that shown in FIG. 4.

When friction coated labels 10 are installed into the pocket 44 as shown in FIG. 6, the bottom edge 48 of the label 48 will typically gravitationally rest upon the bottom support base 42 of the label holder 24 to provide vertical retention. In the alternative or in addition, a label 10 may be horizontally clamped between panels 38, 40 by virtue of the resilient nature of the label holder 24 and the integral hinge provided by the support base 42 or other similar such clamping mechanism.

The structure and operation of the label holder 26 shown in FIG. 5 will readily be understood by one skilled in the art to be similar to that shown in FIG. 4. However, one difference that should be noted is that the label holder shown in FIG. 4 holds typically only one label 10, while the label holder 26 of FIG. 5 may extend the horizontal length of the shelf 34 and therefore may hold several labels corresponding to different merchandise organized along the horizontal length of the shelf. For the label holder 24 shown in FIG. 4, the friction coating 14 on the labels 10 prevents installed labels from falling out. For the label holder 26 shown in FIG. 5, the friction coating 14 on the labels 10 prevents installed labels from falling out and/or migrating out of position and thereby better ensures the correct labeling of corresponding merchandise.

In a preferred embodiment of the invention, the friction coating 14 is provided by an adhesive that is preferably weak and not strong enough to self-support the label in retail applications. There specifically the adhesive is not strong enough to reliably hold labels in retail store applications without vertical contact between the bottom edge 48 of the label and the support base 42 of the label holder 24 for direct support and/or the clamping action provided by the label holder 24. Such a weaker adhesive advantageously allows for easier manual installation and removal of labels 10 without substantial concerns of a strong adhesive causing the label to stick and inhibit installation. Thus, the adhesive friction coating 14 of the label 10 according to a preferred embodiment may not be considered strong enough to be considered a permanent adhesive or a removable adhesive which are typically considered strong enough not only to increase friction (i.e. provide the function of friction coating) but also to form an adhesive bond that reliably self supports the label solely through the adhesive bond of the adhesive and without any additional support from the label holder (e.g. needs no vertical support at the bottom edge of the label or clamping mechanism).

In this regard, and according to a preferred embodiment of the present invention, the friction coating 14 may comprise a weak adhesive of any of the aforementioned types, in which the weak adhesive has an adhesive release value of less than about 0.1 and more preferably between about 0.00 and about 0.05 lbs per square inch along an adhesive axis 50 generally perpendicular to the label 10. The adhesive release value is a measurement of the force required to release the label 10 from the surface to which it is applied such as a flat plastic panel of a label holder. The weak adhesive of the friction coating 14 advantages increases the skid resistance or tendency to slip over conventional paper stock material. According to a preferred embodiment of the present invention, the friction coating provides a skid value of between about 1 to about 30 ounces for the label along a horizontal skid axis 52 generally parallel with the label 10, and more preferably above about 10 ounces. The skid value is a measurement of the force at which the label 10 starts to skid and move along the horizontal skid axis 52. These above force measurements can be done using a spring force measure gauge applied to a standard size 1"×2" paper label. For skid measurements, and using a simple spring force measure gauge, pressure is applied at a 45-degree angle from upright to measure how much force (in ounces) is needed to move the paper tags. The tip of the gauge is a vinyl coated 0.30" placed at the center of a 1"×2" paper label.

Figure 1:
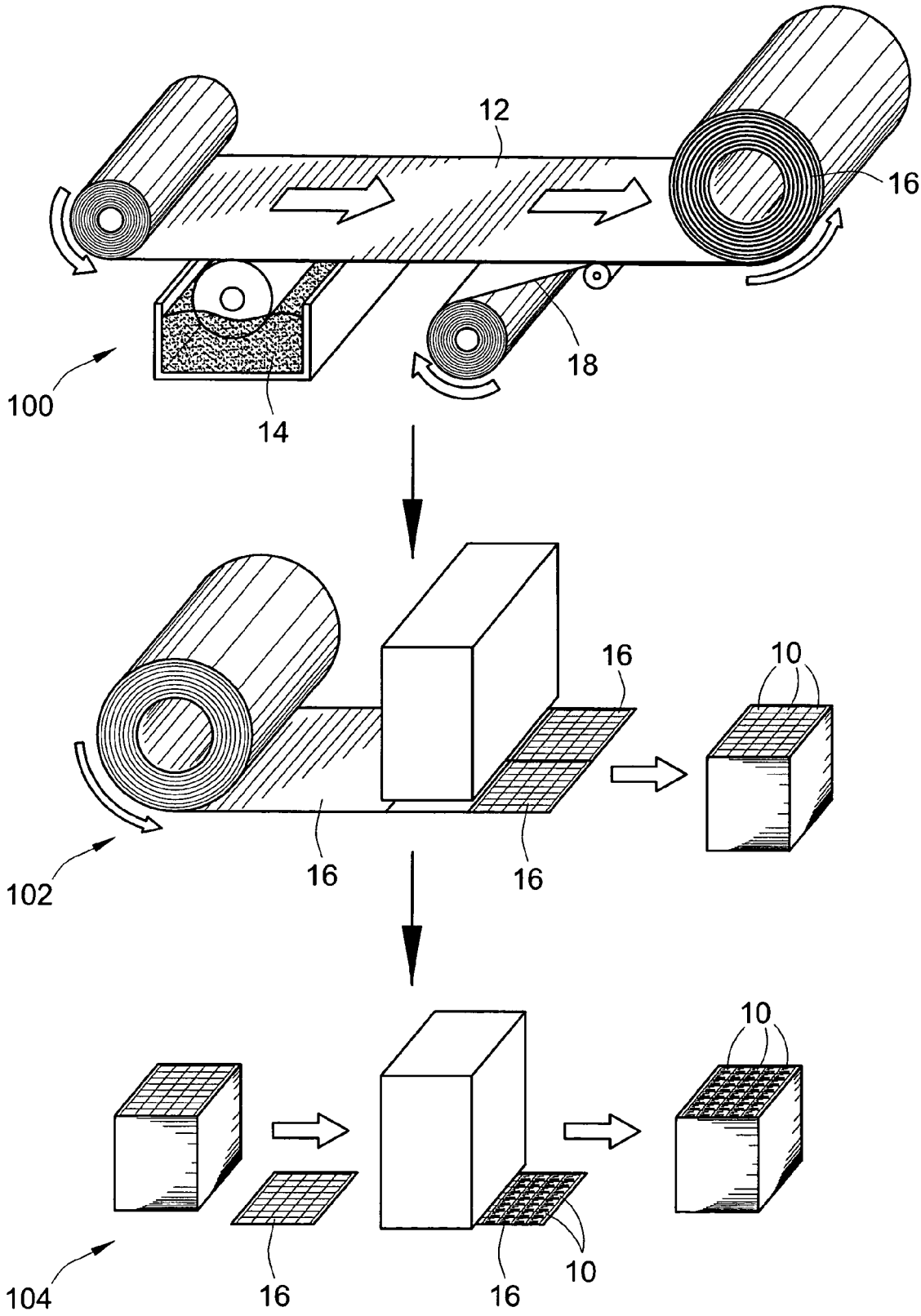
FIG. 1 is a schematic representation of the preparation of friction coated labels in accordance with an embodiment of the invention.

At least some adhesion along the adhesive axis 50 preferably exists between the release liner 18 and the face stock material 12. This is provided by the adhesive tackiness of the friction coating 14 and/or a result of the manufacturing process 100 schematically illustrate in FIG. 1. This provides a sufficient bond between the face stock material 12 and the release liner 18 to allow for subsequent die cutting and background printing operations 102 to transform sheet 16 material into the individual labels 10, which is typically done by a retail supplier such as Southern Imperial, Inc. It also provides a sufficient bond to allow for further processing such as subsequent printing operations 104 of variable data information 20, 22 such as with a laser printer, which is typically done by the retailer. Subsequent die cutting and background printing operations 102 and variable data printing operations 104 can therefore be accomplished without individual labels 10 detaching and falling off the release liner 18 from processing. Thus, the labels 10 stay organized on the release liner 18 until it is desired to install labels into label holders.

However, the adhesive of friction coating 14 is also weak enough to enable manual installation and removal of the label while leaving the label holder substantially completely free of adhesive residue and face stock residue and without damaging the face stock 12. Further, the adhesive of the friction coating 14 is preferably weak enough so not as to unduly inhibit or make difficult manual installation of labels into label holders 24, 26 which could otherwise result with a stronger adhesive. Such potential difficulty may be appreciated with reference to FIGS. 4 and 5.

The particular formulation or specific type of adhesive used for the friction coating 14 of the label 10 is not of importance to the invention, since such labels made to specifications set forth herein are commercially available. For example, commercially available labels according to the preferred specifications set forth herein are readily available from American Coated Products, Inc., located at 7436 South Mayflower Park Drive, Zionsville, Ind. 46077, and/or any other experienced laminating and coating company.

Although different sizes and shapes of labels are possible and depend upon configuration of the label holder, a label 10 according to the present invention preferably is rectangular in shape with a vertical height of between about ¾ inch and about 1¼ inches, a horizontal width of between about 1½ inches and about 4 inches, and a thickness of less than about $1/16^{th}$ inch to make it suitable for most label holder applications. Most standard merchandise labels are typically sized 1 inch by 2 inches.

Figure 8:
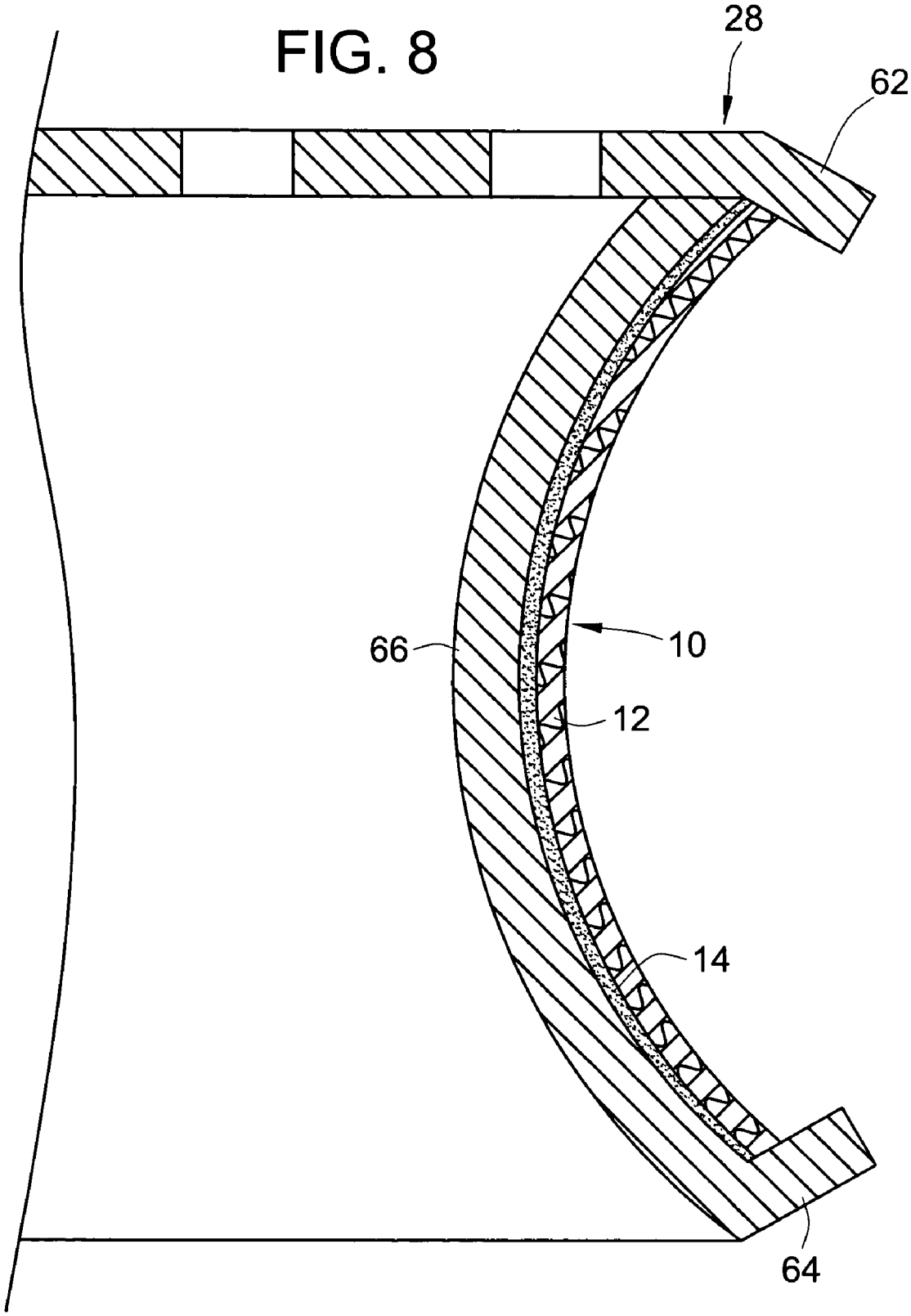
FIG. 8 is a cross sectional illustration of friction coated label as installed in a C-channel shelf of FIG. 7.

A further embodiment of the present invention is a C-channel application as shown in FIGS. 7–8, in which friction coated labels 10 are snapped into a front end C-channel 60 of a C-Channel type shelving unit 28. The C-Channel 60 includes upper and lower horizontal lip edges 62, 64 and a slightly curved support back 66. The vertical distance between lip edges 62, 64 which is shorter than the label height serves as a clamping mechanism because when labels 10 are flexed and snapped into the C-Channel, the resilient nature of the labels 10 cause the labels to want to expand to their natural planar state causing the labels 10 to in effect be clamped between the lip edges 62, 64. The bottom lip edge 64 vertically supports the bottom edge 48 of the label 10 such that the label 10 is supported regardless of whether an adhesive bond forms between the label 10 and the C-Channel, thus releasably securing the label 10 to the C-Channel shelving unit 28. In keeping with the present invention, the friction coating 14 on the face stock material 12 partially or fully engages the curved support back 66 to prevent horizontal migration of the label 10 in the horizontal channel track of the C-Channel 60. The same or similar advantages and benefits as described above for extruded plastic label holder applications are therefore also achieved for C-channel applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A labeling system for using labels to provide information pertaining to merchandise, comprising a merchandiser adapted to support said merchandise;

a label holder mounted to merchandiser, the label holder including means for supporting one or more labels without an adhesive bond;

a friction coated label removably secured to the label holder by the support means, the lable including a face stock and a friction coating, the face stock having printed indicia thereon relating to the merchandise, the friction coating disposed between the face stock and the label holder to inhibit migration of the label relative to the label holder, the friction coating comprising a weak adhesive selected from a group consisting of a rubber-based adhesive, an acrylic emulsion adhesive, a dry bond adhesive, a hot melt adhesive, a solvent-based adhesive, and a water-based adhesive; and wherein the weak adhesive is not strong enough to adhesively bond the friction coated label to the lable without said support means during retail use of the merchandiser.

2. The labeling system of claim 1, wherein the label has a vertical height of between about ¾ inch and about 1¼ inches, a horizontal width of between about 1½ inches and about 4 inches, and a thickness of less than about $1/16^{th}$ inch.

3. The labeling system of claim 1, wherein the face stock is made from a material selected from the group comprising polypropylene, polyethylene, polyester, polyolefin, polystyrene, other polymeric material, vinyl or paper.

4. The labeling system of claim 1, wherein the friction coating is weak enough to enable manual installation and removal of the label while leaving the label holder substantially completely free of residue and without damaging the face stock.

5. The labeling system of claim 1, wherein the printed indicia include a bar code and a list price.

6. The labeling system of claim 1, wherein the weak adhesive has a skid value of between about 1 to about 30 ounces for the label along a skid axis generally parallel with the label to allow for skidding movement of the label.

7. The labeling system of claim 6, wherein the skid value is greater than about 10 ounces.

8. The labeling system of claim 6, wherein the weak adhesive has a release value of less than about 0.01 lbs per square inch along an adhesive axis generally perpendicular to the label to provide for release of the label.

9. The labeling system of claim 8, wherein the release value is between about 0.00 and about .05 lbs per square inch.

10. The labeling system of claim 1, wherein the label holder is a plastic tag holder having a generally planar label pocket defined between two generally co-planar plastic panels, at least one of the plastic panels being transparent for communicating the printed indicia therethrough, and wherein the friction coated label is removably installed in the label pocket, the friction coating disposed between the face stock and at least one of the plastic panels to prevent migration of the label relative to the plastic tag holder.

11. The labeling system of claim 1, wherein the label holder is a C-channel label holder extending horizontally across the merchandiser, the C-Channel label holder comprising a pair of parallel upper and lower retaining lips extending forwardly from a curved back surface that extends vertically between the retaining lips, the friction coated label being removably snapped into the C-channel, the label including top and bottom edges and being resiliently flexed to generally conform to the shape of the C-channel with top and bottom edges engaging the upper and lower retaining lips to retain the label in the C-channel.

12. The labeling system of claim 1, wherein the support means includes at least one of a clamp mechanism clamping the friction coated label and a bottom support gravitationally supporting a bottom edge of the fiction coated label.

* * * * *

UNITED STATES PATENT AND TRADEMARK OFFICE

CERTIFICATE OF CORRECTION

PATENT NO. : 7,155,853 B2
APPLICATION NO. : 10/689283
DATED : January 2, 2007
INVENTOR(S) : Thomas E. Valiulis It is certified that error appears in the above-identified patent and that said Letters Patent is hereby corrected as shown below:

In claim 1, line 14, a colon should be inserted after the word "comprising".

In claim 1, line 20, the word should be correctly spelled --label--.

In claim 1, line 31, the word should be correctly spelled --label-- and the word --holder-- should be inserted after the word "label".

Signed and Sealed this

Sixth Day of March, 2007

JON W. DUDAS
*Director of the United States Patent and Trademark Office*